US009041308B2

(12) United States Patent
Hatley et al.

(10) Patent No.: US 9,041,308 B2
(45) Date of Patent: May 26, 2015

(54) SYSTEMS AND METHODS OF CONTROLLING THE OUTPUT OF A LIGHT FIXTURE

(71) Applicant: Electronic Theatre Controls, Inc., Middleton, WI (US)

(72) Inventors: Troy Bryan Hatley, Lodi, WI (US); Timothy George Robbins, Dane, WI (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 14/531,678

(22) Filed: Nov. 3, 2014

(65) Prior Publication Data

US 2015/0054427 A1 Feb. 26, 2015

Related U.S. Application Data

(63) Continuation of application No. 12/942,509, filed on Nov. 9, 2010, now Pat. No. 8,878,455.

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.
CPC ..... *H05B 33/0845* (2013.01); *H05B 33/0857* (2013.01)

(58) Field of Classification Search
None
See application file for complete search history.

(56) References Cited

U.S. PATENT DOCUMENTS

2008/0278094 A1* 11/2008 Geerts et al. ..... 315/291

* cited by examiner

*Primary Examiner* — Douglas W Owens
*Assistant Examiner* — Dedei K Hammond
(74) *Attorney, Agent, or Firm* — Michael Best & Friedrich LLP

(57) ABSTRACT

Systems and methods of controlling the output of a light fixture. The light fixture includes a plurality of light sources and a controller. The controller is configured to receive a first input control value for a first control parameter and a first input control value for a second control parameter. The controller is also configured to determine a first difference between the first input control value for the first control parameter and a second input control value for the first control parameter stored in a memory and determine a second difference between the first input control value for the second control parameter and a second input control value for the second control parameter stored in the memory. The controller is also configured to set a slew time based on the first determined difference when the first determined difference is greater than the second determined difference and based on the second determined difference when the second determined difference is greater than the first determined difference.

18 Claims, 7 Drawing Sheets

SYSTEMS AND METHODS OF CONTROLLING THE OUTPUT OF A LIGHT FIXTURE

CROSS-REFERENCE TO RELATED APPLICATIONS

This application is a continuation of U.S. patent application Ser. No. 12/942,509, entitled "SYSTEM AND METHOD OF CONTROLLING THE OUTPUT OF A LIGHT FIXTURE" filed Nov. 9, 2010, which is incorporated herein by reference in its entirety.

BACKGROUND

The present invention relates to systems and methods of controlling the output of a light fixture.

Light emitting diodes ("LEDs") are solid state light sources that produce light in a relatively narrow band of wavelengths. Common wavelengths for LEDs correspond to the colors red, green, blue, etc., and can be combined to produce a total output of, for example, a light fixture. Conventionally, LEDs respond quickly to changes in input voltage or current. For example, if an LED that is in an off-state has a sufficient voltage drop across it, the LED transitions from the off-state to an illuminated state substantially immediately.

SUMMARY

As a result of LEDs switching operational states (e.g., from an off-state to an illuminated-state) very quickly, the output of an LED luminaire or light fixture is capable of switching from one color to another almost immediately. When using conventional light sources (e.g., incandescent light sources), the output of a light fixture generally changes more slowly. For example, the outputs of incandescent light sources take a noticeable amount of time to change from one state or one color to another. Because LEDs change state almost immediately, and if a control input is changing quickly (e.g., a user is continually modifying a desired output), the changes in color output of the light fixture result in choppy and erratic transitions from one color to another.

As such, the invention provides systems and methods for controlling the output of a luminaire or light fixture that includes one or more LEDs. A controller receives a set of input data that is indicative of a desired output (e.g., color) of the light fixture. The input data is received, for example, as an input stream of data. The input data is converted to drive levels (e.g., output intensity values) for each of the LEDs in the light fixture. The input data is also compared to a previous set of input data to determine a difference between or a change in the input data. A slew time parameter (i.e., the amount of time an output of a light fixture is to take to transition from one output to another) for the light fixture is then set based on the change in the input data. For example, the amount of change in the input parameter is inversely related to the slew time. As such, the smaller the change in the input data, the greater the amount of time the light fixture will take to transition from one output to the next. Conversely, the greater the amount of change in the input data the lesser the amount of time the light fixture takes to transition from one output to the next. As described in greater detail below, the slew time is different from a slew rate. Additionally, references to a time or times are used generally herein to identify the occurrence of an event or to describe a temporal disparity between two events (e.g., an amount of time between receiving sets of input data, an amount of time the light fixture is to take to transition from one output to another, etc.). In some implementations, time is described in units of seconds, milliseconds, or the like. In other implementations, time is described in terms of, for example, a counter that is configured to increment or decrement based on a signal (e.g., a clock signal).

In another embodiment, the invention provides a method of controlling the output of a light fixture. The light fixture includes a plurality of light sources. The method includes receiving a set of input data including a first input control value for a first control parameter and a first input control value for a second control parameter. The method also includes determining a first difference between the first input control value for the first control parameter and a second input control value for the first control parameter stored in a memory and determining a second difference between the first input control value for the second control parameter and a second input control value for the second control parameter stored in the memory. The method also includes setting a slew time based on the first determined difference when the first determined difference is greater than the second determined difference and setting the slew time based on the second determined difference when the second determined difference is greater than the first determined difference. The slew time corresponds to the amount of time the output of the light fixture is to take to transition from a present output of the light fixture to a new output of the light fixture. The method also includes controlling the output of the light fixture based on the slew time.

In one embodiment, the invention provides a light fixture that includes a plurality of light sources and a controller. The controller is configured to receive a set of input data including a first input control value for a first control parameter and a first input control value for a second control parameter. The controller is also configured to determine a first difference between the first input control value for the first control parameter and a second input control value for the first control parameter stored in a memory and determine a second difference between the first input control value for the second control parameter and a second input control value for the second control parameter stored in the memory. The controller is also configured to set a slew time based on the first determined difference when the first determined difference is greater than the second determined difference and set the slew time based on the second determined difference when the second determined difference is greater than the first determined difference. The slew time corresponds to an amount of time an output of the light fixture is to take to transition from a present output of the light fixture to a new output of the light fixture. The controller is also configured to control the output of the light fixture based on the slew time.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The invention described herein relates to controlling the output of a luminaire or light fixture. The light fixture includes, among other things, a plurality of light sources (e.g., LEDs) and a controller. The controller is configured to regulate or control the amount of time that an output of the light fixture is to take to transition from one output (e.g., color) to another. For example, LEDs are capable of changing state (e.g., intensity level, color, etc.) very quickly. As a result, the total output of an LED light fixture can be controlled precisely and with almost no perceptible delay between when the light fixture receives a control signal (i.e., corresponding to a desired color) and when the output of the light fixture is driven to produce the desired color. However, abrupt changes in the output of the light fixture make the output of the light fixture appear erratic and choppy. As such, the controller is configured to reduce the rate at which the output of the light fixture changes by setting a slew time or slew time parameter. The slew time is based on a difference between a first set of input data (e.g., a first desired color) and the second set of input data (e.g., a second desired color), and corresponds to the amount of time that the output of the light fixture is to take to transition from one output to another. For example, the slew time is inversely related to the difference between the first set of input data and the second set of input data. The slew time is operable to consistently smooth the output of the light fixture as it transitions from one output to another.

Figure 1:
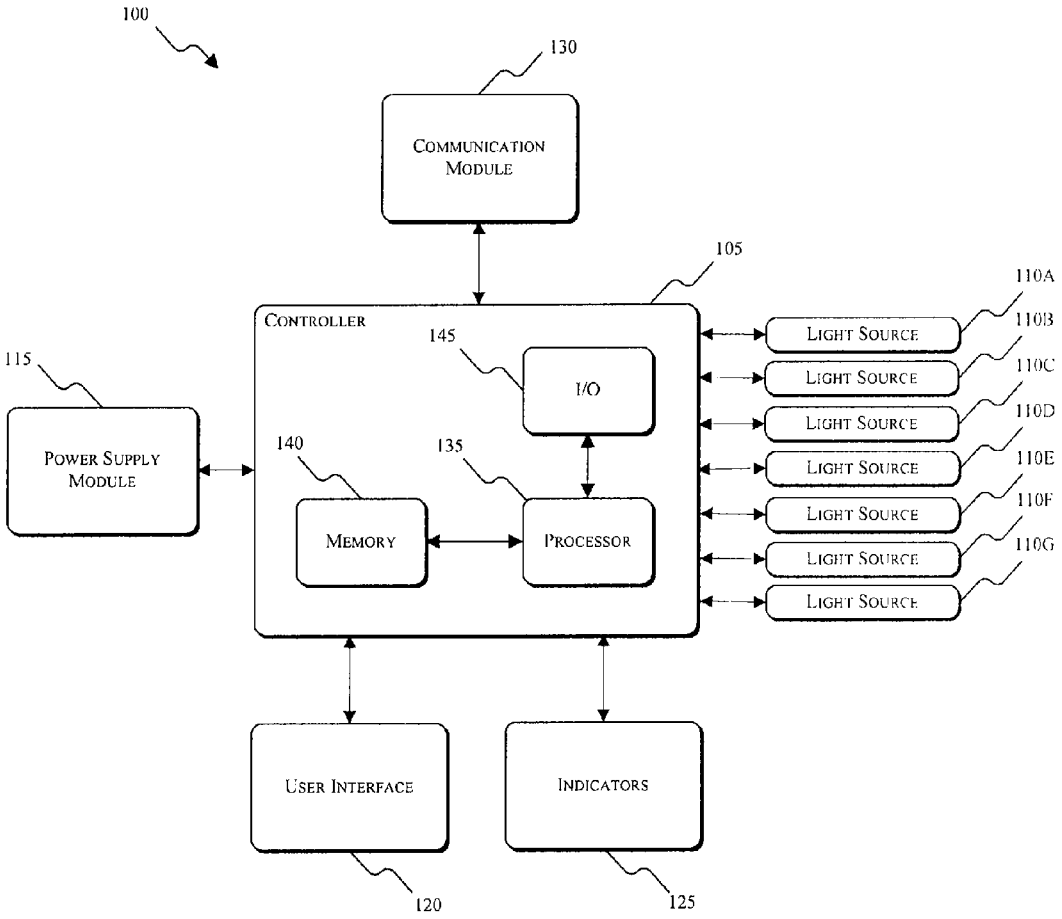
FIG. 1 is a block diagram of a light fixture.

In some implementations, the light fixtures are used in, for example, a theatre, a hall, an auditorium, a studio, or the like. Each light fixture 100 includes, among other things, a controller 105, a plurality of light sources 110A-110G, a power supply module 115, a user interface 120, one or more indicators 125, and a communications module 130, as shown in FIG. 1. In the illustrated construction, the light fixture 100 includes seven light sources 110A-110G. Each light source is configured to generate light at a specific wavelength or range of wavelengths. For example, the light sources 110A-110G generate light corresponding to the colors red, red-orange, amber, green, cyan, blue, and indigo. In other constructions, light sources that generate different colors are used (e.g., violet, yellow, etc.).

The controller 105 includes, or is connected to an external device (e.g., a computer), which includes combinations of software and hardware that are operable to, among other things, control the operation of one or more of the light fixtures, control the output of each of the light sources 110A-110G, and activate the one or more indicators 125 (e.g., LEDs or a liquid crystal display ("LCD")). In one construction, the controller 105 or external device includes a printed circuit board ("PCB") that is populated with a plurality of electrical and electronic components that provide, power, operational control, and protection to the light fixtures. In some constructions, the PCB includes, for example, a processing unit 135 (e.g., a microprocessor, a microcontroller, or another suitable programmable device), a memory 140, and a bus. The bus connects various components of the PCB including the memory 140 to the processing unit 135. The memory 140 includes, for example, a read-only memory ("ROM"), a random access memory ("RAM"), an electrically erasable programmable read-only memory ("EEPROM"), a flash memory, a hard disk, or another suitable magnetic, optical, physical, or electronic memory device. The processing unit 135 is connected to the memory 140 and executes software that is capable of being stored in the RAM (e.g., during execution), the ROM (e.g., on a generally permanent basis), or another non-transitory computer readable medium such as another memory or a disc. Additionally or alternatively, the memory 140 is included in the processing unit 135. The controller 105 also includes an input/output ("I/O") system 145 that includes routines for transferring information between components within the controller 105 and other components of the light fixtures or lighting system. For example, the communications module 130 is configured to provide communications between the light fixture 100 and one or more additional light fixtures or another control device within a lighting system.

Software included in the implementation of the light fixture 100 is stored in the memory 140 of the controller 105. The software includes, for example, firmware, one or more applications, program data, one or more program modules, and other executable instructions. The controller 105 is configured to retrieve from memory and execute, among other things, instructions related to the control processes and methods described below. For example, the controller 105 is configured to execute instructions retrieved from the memory 140 for performing a mathematical transformation of a control value to a value that is required to drive the light sources 110A-110G to produce a desired color. In other constructions, the controller 105 or external device includes additional, fewer, or different components.

The PCB also includes, among other things, a plurality of additional passive and active components such as resistors, capacitors, inductors, integrated circuits, and amplifiers. These components are arranged and connected to provide a plurality of electrical functions to the PCB including, among other things, filtering, signal conditioning, or voltage regulation. For descriptive purposes, the PCB and the electrical components populated on the PCB are collectively referred to as the controller 105.

The user interface 120 is included to control the light fixture 100 or the operation of a lighting system as a whole. The user interface 120 is operably coupled to the controller 105 to control, for example, the output of the light sources 110A-110G. The user interface 120 can include any combination of digital and analog input devices required to achieve a desired level of control for the system. For example, the user interface 120 can include a computer having a display and input devices, a touch-screen display, a plurality of knobs, dials, switches, buttons, faders, or the like. In some constructions, the user interface is separated from the light fixture 100.

The power supply module 115 supplies a nominal AC or DC voltage to the light fixture 100 or system of light fixtures. The power supply module 115 is powered by mains power having nominal line voltages between, for example, 100V and 240V AC and frequencies of approximately 50-60 Hz. The power supply module 115 is also configured to supply lower voltages to operate circuits and components within the light fixture 100. In other constructions, the light fixture 100 is powered by one or more batteries or battery packs.

As illustrated in FIG. 1, the controller 105 is connected to light sources 110A-110G. In other constructions, the controller 105 is connected to, for example, red, green, and blue ("RGB") light sources, red, green, blue, and amber ("RGBA") light sources, red, green, blue, and white ("RGBW") light sources, or other combinations of light sources. A seven light source implementation is illustrated because it is operable to reproduce substantially the entire spectrum of visible light. In other implementations, eight or more light sources are used to further enhance the light fixtures ability to reproduce visible light.

Figure 2:
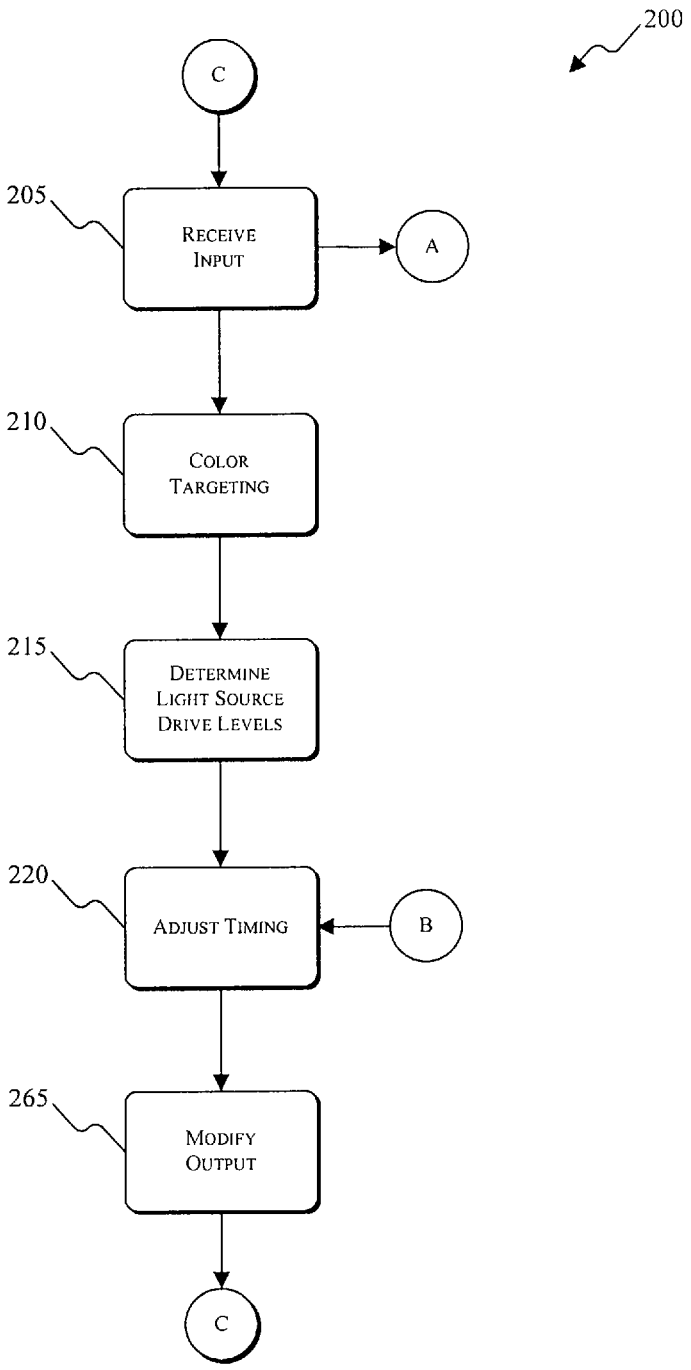
FIGS. 2-3 represent a process for controlling the output of a light fixture.
Figure 3:
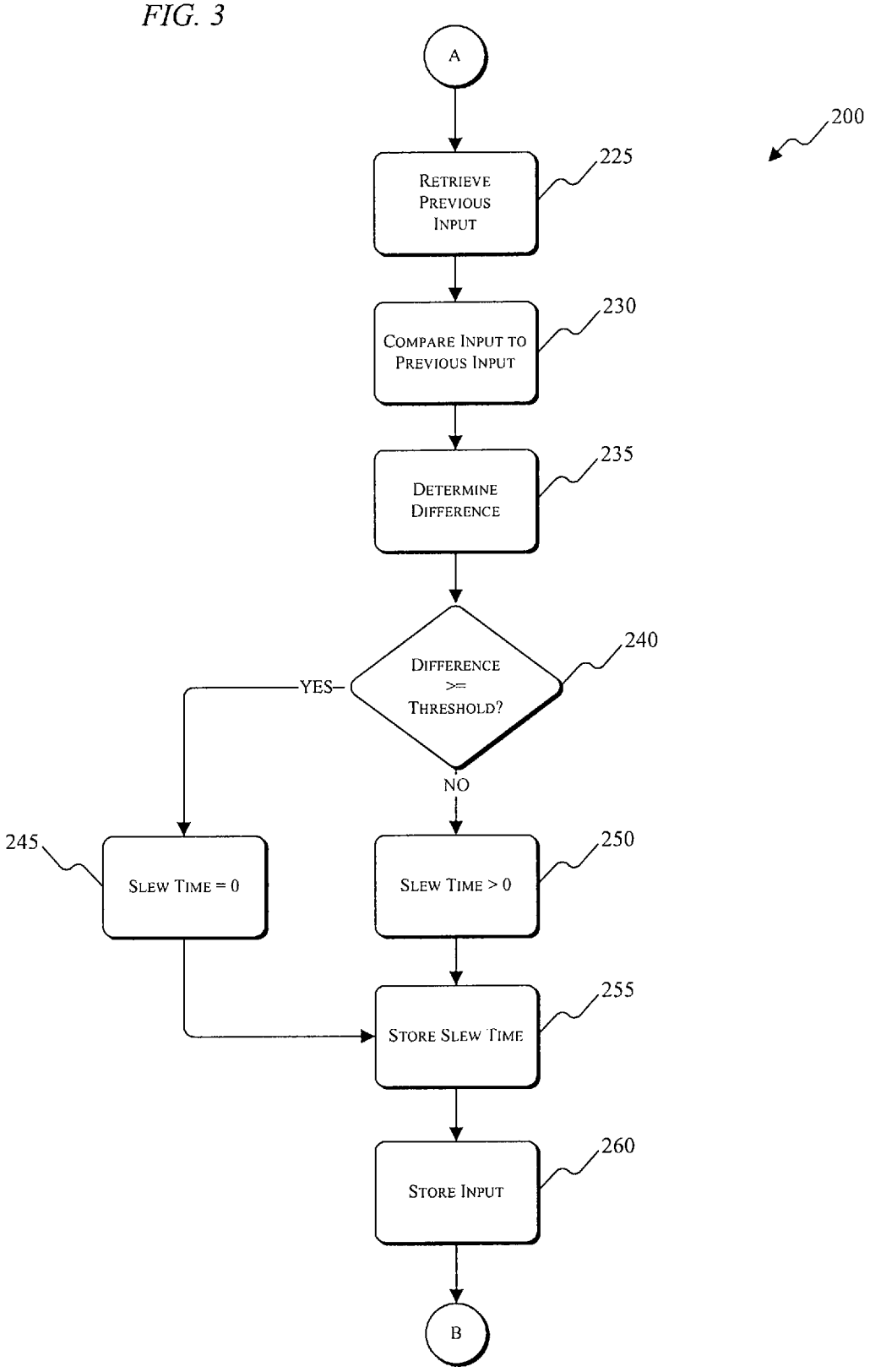

FIGS. 2-3 show a process 200 for controlling the output of a light fixture (e.g., light fixture 100). At step 205, an input is received by the light fixture 100 or the controller 105. The input is, for example, a streaming input of data values, a data packet, a set of data, etc. that corresponds to a desired output of the light fixture (e.g., a color). In some constructions, the set of input data is unique to the light fixture 100 (e.g., within a lighting system that includes multiple light fixtures). For example, the user interface 120 includes a combination of digital and analog input devices that are manipulable by a user to select a desired output or control another characteristic of the light fixture 100. The user interface 120 can include a computer having a display and input devices, a touch-screen display, a plurality of knobs, a plurality of dials, a plurality of switches, a plurality of buttons, or the like, as described above. In other constructions, the light fixture 100 receives the input data from a computer or controller that is external to the light fixture 100.

After the input data has been received, the input data is transmitted or transferred to both a color targeting module and a comparison module (e.g., within the controller 105). In the color targeting module, the set of input data is processed and evaluated in order to determine the output of the light fixture associated with the input data (step 210). The color targeting module is configured to convert the input data from any of a variety of complex color control methodologies (e.g., RGB, CYM, YIQ, YUV, HSV, HLS, XYS, etc.) to determine the desired output of the light fixture 100 (e.g., an integer value corresponding to the desired output). After the desired output has been identified based on the set of input data, the drive levels for each of the plurality of light sources 110A-110G in the light fixture 100 that are required to drive the output of the light fixture 100 to the desired output are determined (step 215). In some implementations, a color creation and matching technique such as that disclosed in U.S. patent application Ser. No. 12/898,127, filed Oct. 5, 2010 and titled "SYSTEM AND METHOD FOR COLOR CREATION MATCHING," the entire content of which is hereby incorporated by reference, is used. After step 215, the timing of the transition from a present output of the light fixture to the new output of the light fixture is adjusted (step 220).

The timing of the transition of the output of the light fixture is adjusted based on a timing factor or slew time. The slew time is determined in section A of the process 200 shown in and described with respect to FIG. 3. In some implementations, section A of the process 200 is executed in parallel to steps 210 and 215. With reference to FIG. 3, a previous set of input data is retrieved from memory (step 225), such as memory 140. The input data is, for example, one byte of data (i.e., 8-bits of data) that correspond to a desired output value (e.g., a color). In other implementations, the input data is an integer between 0 and 255 (i.e., a numerical representation of 8-bits of data) or an integer between 0 and 65535 (i.e., a numerical representation of 16-bits of data). The new set of input data is then compared to the previous set of input data (step 230). For example, the new set of input data is compared to the previous set of input data by calculating a change in or difference between the new set of input data and the previous set of input data (step 235). The difference between the new input data and the previous input data is calculated using integer subtraction (i.e., when the set of input data corresponds to an integer between 0 and 255 or 0 and 65535), using a binary subtraction method (e.g., two's complement subtraction, etc.), or the like.

The difference between the new set of input data and the previous set of input data is then compared to one or more threshold values (step 240). If the change between the previous set of input data and the new set of input data is greater than or equal to the threshold value, a slew time is set to zero or another arbitrarily low number (step 245). The threshold value corresponds to a difference between the new input data and the previous input data for which the transition of the light fixture output from one output level to the other is not substantially impeded (i.e., the LEDs in the light fixture are allowed to transition from one drive level to another at their natural rate). If, at step 240, the change from the previous set of input data to the new set of input data is less than the threshold value, the slew time is set to a value greater than zero or the arbitrarily low number of step 250. Following steps 245 and 250, the slew time is stored in memory (step 255). The new set of input data is also stored to memory (step 260) such that it can be retrieved and compared to a subsequent set of received input data. The process 200 then proceeds to section B shown in and described with respect to FIG. 2.

With reference once again to FIG. 2 and step 220, the timing of the light fixture (i.e., the amount of time the light fixture takes to transition from one color to another) is adjusted based on the set of input data, the light source drive levels associated with the set of input data, and the slew time. After step 220, the present output of the light fixture is controlled or driven to the new output of the light fixture associated with the received set of input data (step 265). The process 200 then returns to step 205 (section C) and receives another new set of input data. The input data may be the same or approximately the same as the input data received immediately prior. In such an instance, the amount of time that the light fixture is to take to transition to the corresponding new output remains the same or approximately the same until there is a change in the input data or the desired output is reached.

Figure 4:
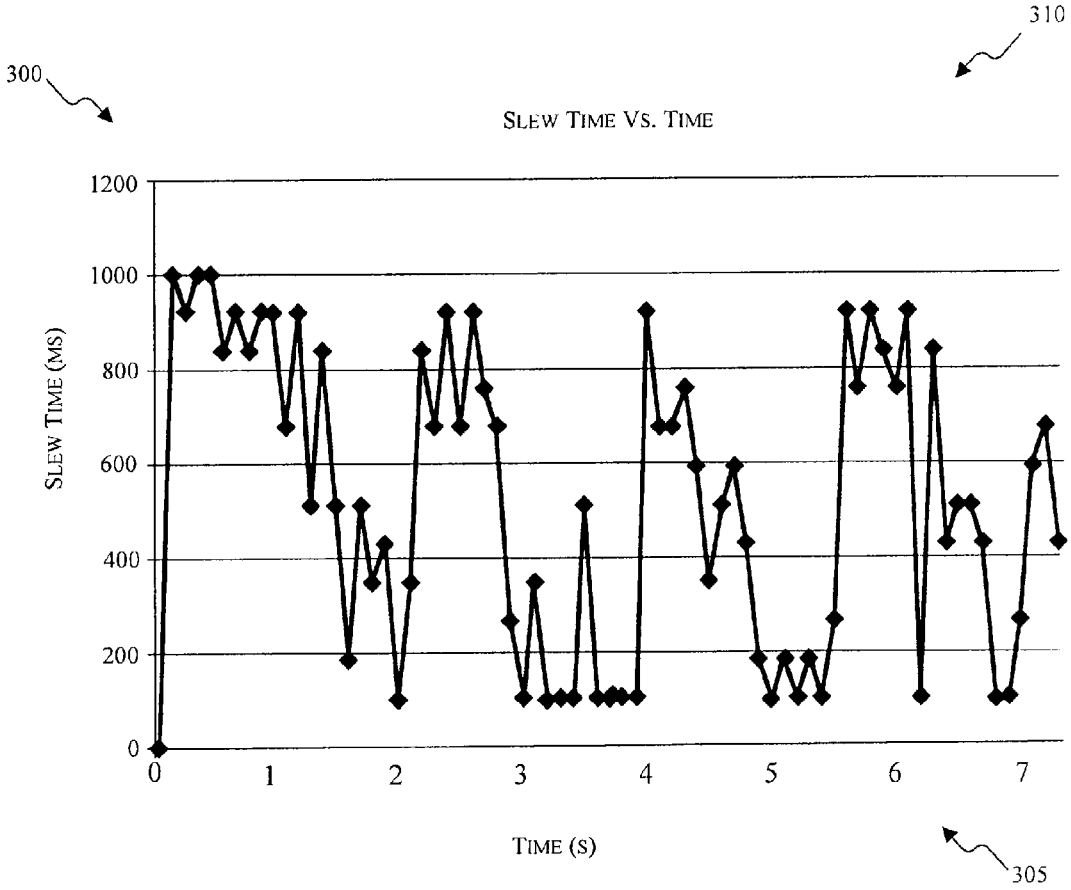
FIG. 4 represents a diagram of slew times with respect to time.

FIGS. 4-7 represent diagrams that show the variation in slew time with respect to time for a reduced set of test data (i.e., a subset of test data) that is representative of the behavior of the slew time with respect to time as an input control is changed. The slew times are provided on the y-axes 300 of each diagram, and time is provided on the x-axes 305 of each diagram. The diagram 310 in FIG. 4 illustrates test data for the variation in slew time as a hue input control of a light fixture is varied from a zero value to a full-scale value, and then from the full-scale value back to the zero value. Because the hue is being modified manually, the rate at which the hue is being changed is inconsistent and demonstrates considerable variance from sample to sample. The variations in the rate at which the hue is changed correspond to the variations in slew time illustrated in FIG. 4. For large slew times (e.g., 1000 ms), the change in hue from one sample to another is small. For small slew times (e.g., 200 ms), the change in hue from one sample to another is relatively large. As such, the slew time is inversely related to the change in input (e.g., hue, saturation, intensity, etc.). In some implementations, the slew times vary within a range of approximately 2.0 seconds to 100 ms. Additionally, the input data described above is received, for example, approximately every 10 ms. In other implementations, the input data is received at different rates (e.g., every 20 ms, 30 ms, etc.). The amount of time that the light fixture takes to transition from one output to another is often greater than the amount of time between samples. For example, if data is received every 10 ms and the selected slew time for a particular transition from one output to another is 20 ms, the output of the light fixture only completes approximately half of the transition to the new output value before the next set of input data is received. If the next set of input data indicates a smaller desired change in the output of the light fixture, the slew time is updated (i.e., made larger) and the output of the light fixture begins to change based on the updated slew time regardless of whether output of the light fixture has reached the previous target output.

Another characteristic of the changes in slew time is that the determined slew time is almost always changing (i.e., is almost never constant). Even when a control input value does not appear to be changing, small fluctuations in the input control value that result from, for example, quantization errors, result in a noisy input signal and fluctuations in the determined slew time. Additionally and although not shown above in FIG. 1, each light source 110A-110G includes a fade engine. The fade engines receive the input control value and a slew time, and are configured to drive the output of the light sources accordingly. Depending on the resolution of the fade engines, the transition from one output of the light fixture to another output of the light fixture is divided into, for example, 255 steps (8-bit resolution). Depending on the desired change in the output, each of the steps may not be exactly the same size. Uneven step size can also result in minor slew time variations.

The reduced sets of data that are illustrated in FIGS. 4-7 are also illustrated numerically by further reduced sets of data (i.e., subsets of the data illustrated in FIGS. 4-7) in Table #'s 1-8 below. The further reduced sets of data retain and highlight the relationships between changes in input controls and slew time. Table #1 and Table #2 correspond to the diagram 310 in FIG. 4. Table #1 illustrates a relationship between the change in hue (i.e., the absolute value of the change in hue) and the slew time. For example, the hue of the light fixture (i.e., the output color of the light fixture) changes from the color represented by an integer value of 512 to the color represented by an integer value of 1024 in 918 ms when the change in the hue is 512. Additionally and as previously described, if a new sample of the input hue corresponds to a change in hue that is different than 512 before the light fixture has reached the target hue value, the slew time is modified based on the new input hue regardless of whether the light fixture has reached the target value.

The smallest change in hue shown in Table #1 corresponds to a slew time of 918 ms, and the largest change in hue shown in Table #1 corresponds to a slew time of 98 ms. As such, the relationship between the absolute value of the change in hue and the slew time is an inverse relationship.

TABLE #1

Slew Times Based on Changes in Hue

| Hue | Previous Hue | ΔHue | Slew Time |
|---|---|---|---|
| 1024 | 512 | 512 | 918 |
| 5888 | 4608 | 1280 | 672 |
| 8192 | 6400 | 1792 | 508 |
| 17664 | 15360 | 2304 | 344 |
| 43520 | 40448 | 3072 | 98 |
| 57344 | 59684 | −2304 | 344 |
| 28928 | 29952 | −1024 | 754 |

Although Table #1 illustrates the changes in the overall hue of the light fixture, the individual light sources within the light fixture can change at different rates than the output hue. For example, a single slew time is set for each sample of the desired hue. The slew time is then applied to the individual changes in the light sources that are necessary to achieve the desired change in hue in the selected period of time. Table #2 illustrates the light source (e.g., LED) output values that are used to produce the hues from Table #1. The light source output values vary from, for example, 0 to 255 (i.e., have 8-bits of resolution). The rate at which the light source output values change varies based on the current value of the light source output values. Although the hue values shown below in Table #2 do not represent consecutive hue input values, they provide an illustrative example of how slew time affects changes in the light source output values.

TABLE 2

Light Source Output Values

| Hue | LS #1 | LS #2 | LS #3 | LS #4 | LS #5 | LS #6 | LS #7 |
|---|---|---|---|---|---|---|---|
| 1024 | 0 | 0 | 20 | 255 | 0 | 0 | 0 |
| 5888 | 0 | 0 | 255 | 22 | 0 | 136 | 0 |
| 8192 | 0 | 0 | 255 | 215 | 0 | 252 | 0 |
| 17664 | 0 | 17 | 113 | 0 | 0 | 255 | 0 |
| 43520 | 255 | 173 | 0 | 0 | 0 | 0 | 239 |
| 57344 | 0 | 0 | 8 | 255 | 0 | 0 | 132 |
| 28928 | 0 | 255 | 0 | 0 | 0 | 255 | 25 |

The hue values of 1024 and 5888 are reproduced below in Table #3 along with the changes in the light source output values for each of the light sources. If, for example, a change in hue input of 4864 (i.e., 5888-1024) results in a slew time of 50 ms, each of the changes in light source output value occurs at a rate that achieves the necessary change in 50 ms. For LED #'s 1, 2, 5, and 7, there is no change in the light source output values. LED #'s 3, 4, and 6 have respective changes in light source output values of 235, −233, and 136. As such, the three light sources having light source output values that must be changed to achieve the desired light fixture output, must all be changed at different rates (i.e., 235/50, −233/50, and 136/50 in input units per ms).

TABLE 3

Chances in Light Source Output Values

| Hue | LS #1 | LS #2 | LS #3 | LS #4 | LS #5 | LS #6 | LS #7 |
|---|---|---|---|---|---|---|---|
| 1024 | 0 | 0 | 20 | 255 | 0 | 0 | 0 |
| 5888 | 0 | 0 | 255 | 22 | 0 | 136 | 0 |
| ΔHue | ΔLS #1 | ΔLS #2 | ΔLS #3 | ΔLS #4 | ΔLS #5 | ΔLS #6 | ΔLS #7 |
| 4864 | 0 | 0 | 235 | −233 | 0 | 136 | 0 |

However, as described above, the slew time is often greater than the amount of time between receiving input data samples. Like the slew time, the light source output values are also updated for each new input hue value. As such, if one or more light sources have not yet reached a previous target light source output value before the next input data sample is received, the output of the light fixture can begin to fall behind, and the rate at which the light source output values are modified has to be adjusted accordingly. For example, the slew time is set based on a difference between a new set of input data and the previous set of input data. If the light fixture is able to achieve the desired output before the slew time is updated, the rate at which the output of the light fixture changes can be calculated by dividing the difference in the input by the slew time, as described above. However, if the output of the light fixture has not reached the desired output before the slew time is updated (i.e., and the input data has changed), the light fixture output and the light source output values must be changed at a different (e.g., greater or lesser) rate in order to achieve the desired output based on the determined slew time.

The slew times and the light source output values are, for example, stored in the memory 140 for each input hue value. Additionally or alternatively, a slew rate (e.g., calculated based on the slew time and the change in hue) and light source output value rates of change (e.g., calculated based on the slew time and the required changes in light source output values) are stored in the memory 140. Slew rate is used generally herein to describe the rate at which the output of the light fixture is to transition from one output (e.g., color) to another. In some implementations, slew rate is also used to describe the transitions from one output to another for other characteristics of the light fixture, such as brightness, color temperature, saturation, intensity, etc.

Figure 5:
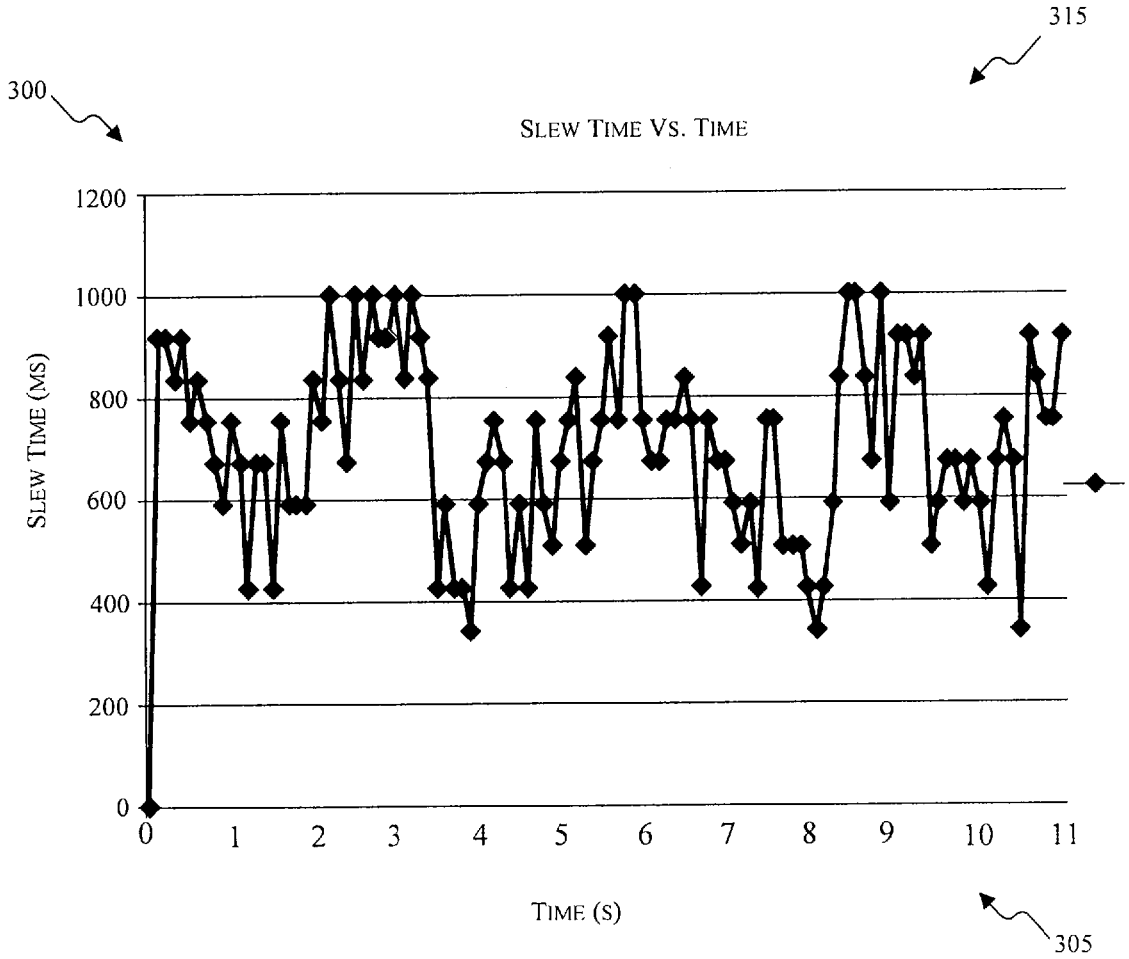
FIG. 5 represents a diagram of slew times with respect to time.

Table #4 and Table #5 correspond to the diagram 315 in FIG. 5. Table #4 illustrates the inverse relationship between the change in hue (i.e., the absolute value of the change in hue) and the slew time. The diagram 315 and the data presented in Table #'s 4 and 5 are similar to diagram 310 in FIG. 4 and Table #'s 1 and 2. The primary difference between the two sets of data is the manner in which the input hue value is modified. The input hue control was manually controlled (i.e., faded or transitioned from zero to full-scale and then back to zero over a period of time) manually to obtain the data in FIG. 4. The input hue control was automatically controlled (i.e., faded or transitioned from zero to full-scale and then back to zero over a period of time) by, for example, the controller 105 or an external device to obtain the data in FIG. 5. In FIG. 4, there are substantial variations in the slew times because the rate at which the input hue value is being changed was inconsistent. As demonstrated by a comparison to FIG. 5, the slew times for diagram 315 are more consistent (i.e., there is less variation between the maximum slew times and the minimum slew times). However, as demonstrated by the data presented in Table #4 below, the inverse relationship between the absolute value of the change in input control value and the corresponding slew time is maintained independently of the manner in which the input control value is modified and the amount of variation in slew times.

TABLE #4

Slew Times Based on Changes in Hue

| Hue | Previous Hue | ΔHue | Slew Time |
|---|---|---|---|
| 768 | 256 | 512 | 918 |
| 3072 | 2048 | 1024 | 754 |
| 7680 | 6144 | 1536 | 590 |
| 16640 | 14592 | 2048 | 426 |
| 65280 | 65024 | 256 | 1000 |
| 65024 | 65280 | −256 | 1000 |
| 33280 | 35584 | −2304 | 344 |

Table #5 illustrates the light source (e.g., LED) output values that are used to produce the hues from Table #4. As described above, the rate at which each of the light sources is changed after receiving a new input control value is independently set and controlled based on the determined slew time and the amount of change that is required to achieve the desired light source output value.

TABLE 5

Light Source Output Values

| Hue | LS #1 | LS #2 | LS #3 | LS #4 | LS #5 | LS #6 | LS #7 |
|---|---|---|---|---|---|---|---|
| 768 | 0 | 0 | 5 | 255 | 0 | 0 | 0 |
| 3072 | 0 | 0 | 214 | 255 | 0 | 0 | 0 |
| 7680 | 0 | 0 | 255 | 225 | 0 | 231 | 0 |
| 16640 | 0 | 17 | 114 | 0 | 0 | 255 | 0 |
| 65280 | 0 | 0 | 0 | 255 | 0 | 0 | 18 |
| 65024 | 0 | 0 | 5 | 255 | 0 | 0 | 19 |
| 33280 | 0 | 255 | 0 | 0 | 0 | 145 | 59 |

Figure 6:
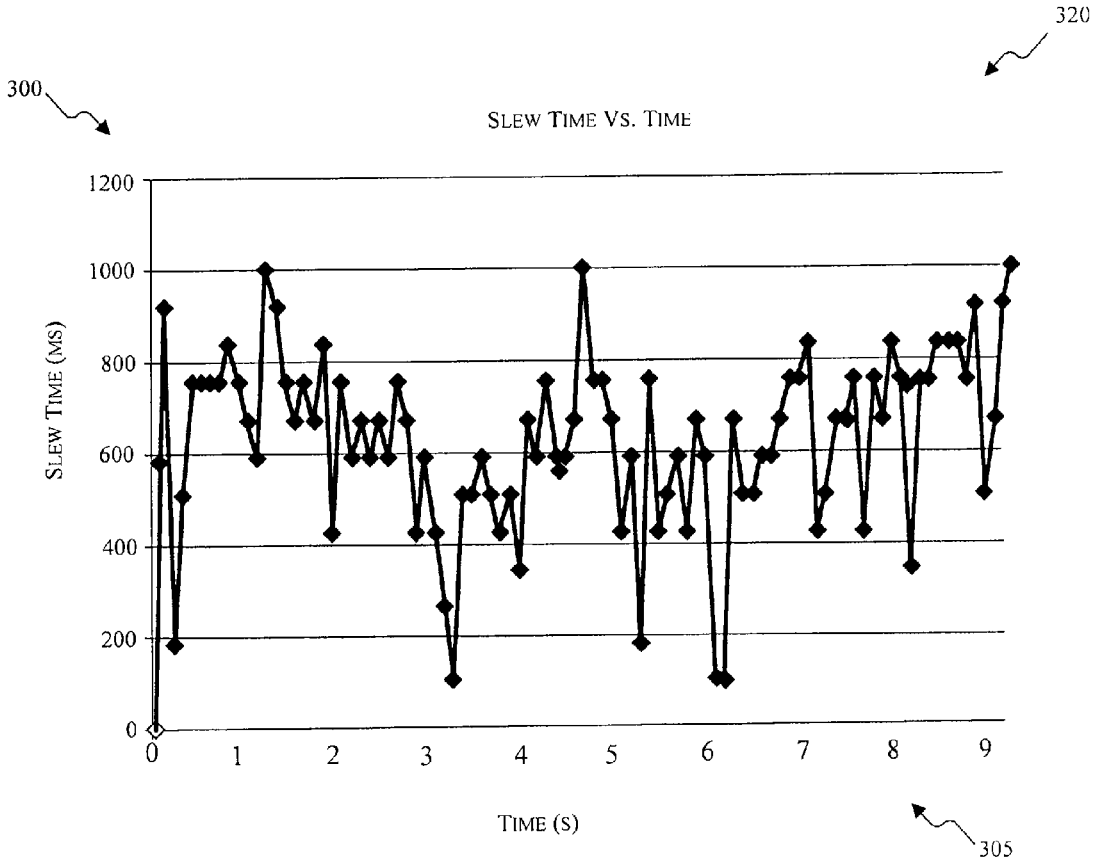
FIG. 6 represents a diagram of slew times with respect to time.

Table #6 and Table #7 correspond to the diagram 320 in FIG. 6. The diagram 320 and the data presented in Table #'s 6 and 7 correspond to a system in which an RGB complex control methodology is used. The input control values for the red, green, and blue light sources vary from, for example, 0 to 255 (i.e., 8-bits of resolution). For descriptive purposes, the green and blue light sources are held at constant, full-scale values of 255, and only the red input control value is modified. Table #6 illustrates a relationship between the change in a red input control value (i.e., the absolute value of the change in the red input control value) and the slew time. As described above with respect to Table #'s 1 and 4, the change in the input control value is inversely related to the corresponding slew time.

TABLE #6

Slew Times Based on Changes in Input

| Red Value | Previous Red Value | ΔRed Value | Slew Time |
|---|---|---|---|
| 13 | 2 | 11 | 180 |
| 55 | 54 | 1 | 1000 |
| 86 | 78 | 8 | 426 |
| 122 | 118 | 4 | 754 |
| 254 | 255 | −1 | 1000 |
| 159 | 172 | −13 | 100 |
| 100 | 103 | −3 | 836 |

Table #7 illustrates the light source (e.g., LED) output values that are used to produce the hues from Table #6. The green and blue input control values are held at constant, full-scale values of 255. The rate at which each of the light source output values is changed after receiving a new input control value is independently set and controlled based on the determined slew time and the amount of change that is required to achieve the desired light source output.

TABLE 7

Light Source Output Values

| Red Value | LS #1 | LS #2 | LS #3 | LS #4 | LS #5 | LS #6 | LS #7 |
|---|---|---|---|---|---|---|---|
| 13 | 0 | 255 | 0 | 0 | 4 | 255 | 100 |
| 55 | 0 | 255 | 0 | 0 | 101 | 255 | 89 |
| 86 | 1 | 252 | 0 | 0 | 205 | 255 | 82 |
| 122 | 0 | 238 | 38 | 0 | 255 | 255 | 100 |
| 254 | 23 | 214 | 230 | 161 | 255 | 252 | 165 |
| 159 | 20 | 227 | 118 | 0 | 255 | 254 | 110 |
| 100 | 0 | 246 | 0 | 0 | 255 | 255 | 84 |

Figure 7:
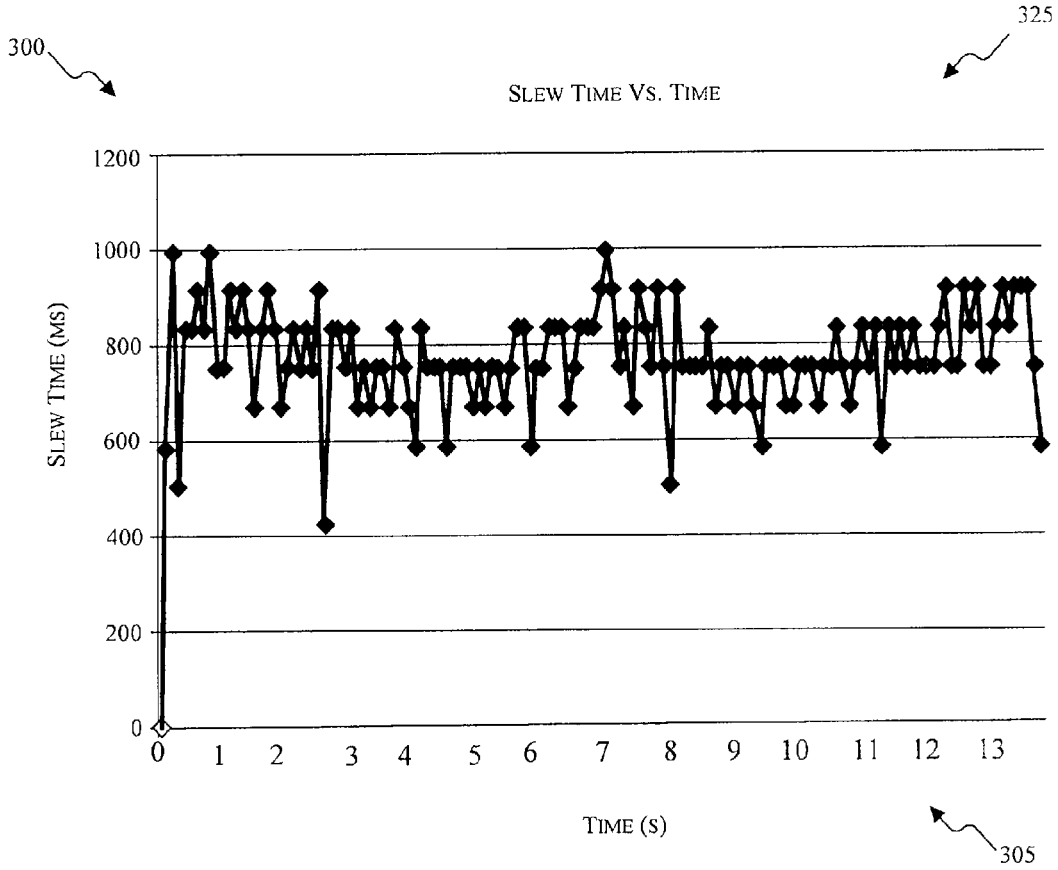
FIG. 7 represents a diagram of slew times with respect to time.

Table #8 and Table #9 correspond to the diagram 325 in FIG. 7. Table #8 illustrates the inverse relationship between the change in the red input control value (i.e., the absolute value of the change in red input control value) and the slew time. The diagram 325 and the data presented in Table #'s 8 and 9 are similar to diagram 325 in FIG. 6 and Table #'s 6 and 7. The primary difference between the two sets of data is the manner in which the red input control value is modified. The red input control value was manually controlled (i.e., faded from zero to full-scale and then back to zero) manually to obtain the data in FIG. 6. The red input control value was automatically controlled by, for example, the controller 105 to obtain the data in FIG. 7. In FIG. 6, there are substantial variations in the slew times because the rate at which the red input control value is being changed was highly inconsistent. As demonstrated by a comparison to FIG. 7, the slew times are more consistent (i.e., there is less variation between the maximum slew times and the minimum slew times) when the fading is controlled by the controller 105.

TABLE #8

Slew Times Based on Changes in Input

| Red Value | Previous Red Value | ΔRed Value | Slew Time |
|---|---|---|---|
| 1 | 0 | 1 | 1000 |
| 16 | 14 | 2 | 918 |
| 28 | 24 | 4 | 754 |
| 84 | 76 | 8 | 426 |
| 218 | 225 | −7 | 508 |
| 184 | 188 | −4 | 754 |
| 47 | 49 | −2 | 918 |

Table #9 illustrates the light source (e.g., LED) output values that correspond to the red input control values from Table #8. The green and blue input control values are held at constant, full-scale values of 255. The rate at which each of the light source output values is changed after receiving a new input control value is independently set and controlled based on the determined slew time and the amount of change that is required to achieve the desired light source output.

TABLE 9

Light Source Output Values

| Red Value | LS #1 | LS #2 | LS #3 | LS #4 | LS #5 | LS #6 | LS #7 |
|---|---|---|---|---|---|---|---|
| 1 | 0 | 255 | 0 | 0 | 0 | 168 | 60 |
| 16 | 0 | 255 | 0 | 0 | 15 | 255 | 95 |
| 28 | 0 | 255 | 0 | 0 | 38 | 255 | 95 |
| 84 | 4 | 253 | 0 | 0 | 195 | 255 | 82 |
| 218 | 39 | 217 | 227 | 57 | 255 | 254 | 140 |
| 184 | 19 | 222 | 180 | 0 | 255 | 255 | 140 |
| 47 | 0 | 255 | 0 | 0 | 78 | 255 | 95 |

As described above, the change in the input control value (e.g., hue, saturation, intensity, red, green, blue, etc.) is inversely related to the slew time. The inverse relationship can correspond to any of a variety of mathematical relationships. For example, the relationship can be a linear, a quadratic, a square root, a cubic, an exponential, a hyperbolic, a logarithmic, a periodic, or a step inverse relationship. In some implementations, combinations of inverse relationships are used. For example, a first range of changes in an input control value are linearly related to slew time, and a second range of changes in the input control value are exponentially related to slew time. Additionally or alternatively, for changes in the input control value above a threshold value, the slew time is set to zero (i.e., the output of the light fixture is allowed to change in an uninhibited manner), or for changes in the input control value below a threshold value, the slew time is set to a maximum value (e.g., 1200 ms).

Thus, the invention provides, among other things, systems and methods for controlling the output of a light fixture based on changes in a control input value. Various features and advantages of the invention are set forth in the following claims.

What is claimed is:

1. A method of controlling an output of a light fixture, the light fixture including a plurality of light sources, the method comprising:

receiving a set of input data including a first input control value for a first control parameter and a first input control value for a second control parameter;

determining a first difference between the first input control value for the first control parameter and a second input control value for the first control parameter stored in a memory;

determining a second difference between the first input control value for the second control parameter and a second input control value for the second control parameter stored in the memory;

setting a slew time based on the first determined difference when the first determined difference is greater than the second determined difference, the slew time corresponding to an amount of time the output of the light fixture is to take to transition from a present output of the light fixture to a new output of the light fixture;

setting the slew time based on the second determined difference when the second determined difference is greater than the first determined difference; and controlling the output of the light fixture based on the slew time.

2. The method of claim 1, wherein the first control parameter is a first light source intensity for a first light source included in the plurality of light sources and the second control parameter is a second light source intensity for a second light source included in the plurality of light sources.

3. The method of claim 1, wherein the first control parameter and the second control parameter are different.

4. The method of claim 1, wherein the first control parameter is one control parameter selected from a group comprising hue, saturation, brightness, color, color temperature, intensity, red, green, and blue.

5. The method of claim 1, wherein the second control parameter is one control parameter selected from a group comprising hue, saturation, brightness, color, color temperature, intensity, red, green, and blue.

6. The method of claim 1, further comprising determining an output intensity value for each of the plurality of light sources based on the first input control value for the first control parameter and the first input control value for the second control parameter.

7. The method of claim 6, further comprising independently driving the plurality of light sources to the determined output intensity value for each of the plurality of light sources at a rate that is based on the slew time.

8. The method of claim 1, wherein if the first determined difference or the second determined difference is greater than or equal to a threshold value, the slew time is set equal to zero.

9. The method of claim 1, wherein if the first determined difference or the second determined difference is greater than or equal to a threshold value, the slew time is set equal to a non-zero minimum value.

10. A light fixture comprising:

a plurality of light sources; and a controller configured to receive a set of input data including a first input control value for a first control parameter and a first input control value for a second control parameter;

determine a first difference between the first input control value for the first control parameter and a second input control value for the first control parameter stored in a memory;

determine a second difference between the first input control value for the second control parameter and a second input control value for the second control parameter stored in the memory;

set a slew time based on the first determined difference when the first determined difference is greater than the second determined difference, the slew time corresponding to an amount of time an output of the light fixture is to take to transition from a present output of the light fixture to a new output of the light fixture;

set the slew time based on the second determined difference when the second determined difference is greater than the first determined difference; and control the output of the light fixture based on the slew time.

11. The light fixture of claim 10, wherein the first control parameter is a first light source intensity for a first light source included in the plurality of light sources and the second control parameter is a second light source intensity for a second light source included in the plurality of light sources.

12. The light fixture of claim 10, wherein the first control parameter and the second control parameter are different.

13. The light fixture of claim 10, wherein the first control parameter is one control parameter selected from a group comprising hue, brightness, saturation, color, color temperature, intensity, red, green, and blue.

14. The light fixture of claim 10, wherein the second control parameter is one control parameter selected from a group comprising hue, brightness, saturation, color, color temperature, intensity, red, green, and blue.

15. The light fixture of claim 10, further the controller is further configured to determine an output intensity value for each of the plurality of light sources based on the first input control value for the first control parameter and the first input control value for the second control parameter.

16. The light fixture of claim 15, further the controller is further configured to independently drive the plurality of light sources to the determined output intensity value for each of the plurality of light sources at a rate that is based on the slew time.

17. The light fixture of claim 10, wherein the controller is further configured to set the slew time equal to zero if the first determined difference or the second determined difference is greater than or equal to a threshold value.

18. The light fixture of claim 10, wherein the controller is further configured to set the slew time equal to a non-zero minimum value if the first determined difference or the second determined difference is greater than or equal to a threshold value.

* * * * *